US012173442B2

(12) United States Patent
Bae

(10) Patent No.: US 12,173,442 B2
(45) Date of Patent: Dec. 24, 2024

(54) METHOD FOR CONTROLLING LAUNDRY TREATING APPARATUS

(71) Applicant: LG ELECTRONICS INC., Seoul (KR)

(72) Inventor: Suncheol Bae, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 807 days.

(21) Appl. No.: 17/273,117

(22) PCT Filed: Sep. 4, 2019

(86) PCT No.: PCT/KR2019/011394
§ 371 (c)(1),
(2) Date: Mar. 3, 2021

(87) PCT Pub. No.: WO2020/050621
PCT Pub. Date: Mar. 12, 2020

(65) Prior Publication Data

US 2021/0340701 A1 Nov. 4, 2021

(30) Foreign Application Priority Data

Sep. 7, 2018 (KR) ..... 10-2018-0106999

(51) Int. Cl.

| | |
|---|---|
| ***D06F 33/40*** | (2020.01) |
| ***D06F 33/44*** | (2020.01) |
| ***D06F 33/47*** | (2020.01) |
| ***D06F 34/14*** | (2020.01) |

(52) U.S. Cl.
CPC ..... *D06F 33/40* (2020.02); *D06F 33/44* (2020.02); *D06F 33/47* (2020.02); *D06F 34/14* (2020.02)

(58) Field of Classification Search
CPC ..... D06F 33/40; D06F 33/44; D06F 33/47; D06F 33/48; D06F 33/60; D06F 33/74; D06F 33/76; D06F 34/14; D06F 34/16; D06F 34/18; D06F 35/007; D06F 2103/02; D06F 2103/04; D06F 2103/26; D06F 2103/46; D06F 2105/08; D06F 2105/46;
(Continued)

(56) References Cited

U.S. PATENT DOCUMENTS

| | | | | |
|---|---|---|---|---|
| 2010/0175199 | A1 | 7/2010 | Kim et al. | |
| 2014/0082958 | A1 | 3/2014 | Chung et al. | |
| 2016/0222574 | A1* | 8/2016 | Bae | D06F 33/40 |

(Continued)

FOREIGN PATENT DOCUMENTS

| | | | |
|---|---|---|---|
| JP | 2003-311065 | A | 11/2003 |
| JP | 2013-180174 | A | 9/2013 |

(Continued)

OTHER PUBLICATIONS

International Search Report and Written Opinion dated Dec. 16, 2019 issued in Application PCT/KR2019/011394.

*Primary Examiner* — David G Cormier
(74) *Attorney, Agent, or Firm* — KED & ASSOCIATES, LLP

(57) ABSTRACT

The present invention relates to a method for controlling a laundry treating apparatus, the method detecting presence or absence of a water-trapping balloon while maintaining a drum speed at a constant speed during a spinning step, thereby to increase the spinning efficiency.

17 Claims, 7 Drawing Sheets

(58) Field of Classification Search
CPC ..... D06F 2105/48; D06F 2105/52; D06F 2105/62
See application file for complete search history.

(56) References Cited

U.S. PATENT DOCUMENTS

| | | | | |
|---|---|---|---|---|
| 2018/0291548 | A1* | 10/2018 | Cho | D06F 33/00 |
| 2020/0040509 | A1* | 2/2020 | Shinohara | D06F 33/48 |

FOREIGN PATENT DOCUMENTS

| | | |
|---|---|---|
| JP | 2018-023626 | 2/2018 |
| KR | 10-2016-0094722 | 8/2016 |
| KR | 10-2018-0089965 A | 8/2018 |

* cited by examiner (a)

(b)

METHOD FOR CONTROLLING LAUNDRY TREATING APPARATUS

CROSS-REFERENCE TO RELATED PATENT APPLICATIONS

This application is a U.S. National Stage Application under 35 U.S.C. § 371 of PCT Application No. PCT/KR2019/011394, filed Sep. 4, 2019, which claims priority to Korean Patent Application No. 10-2018-0106999, filed Sep. 7, 2018, whose entire disclosures are hereby incorporated by reference.

TECHNICAL FIELD

The present disclosure relates to a method for controlling a laundry treating apparatus. More specifically, the present disclosure relates to a method for controlling a laundry treating apparatus in which spinning is continuously performed while immediately detecting a water-trapping balloon from a beginning of a spinning process, thereby to increase a dewatering efficiency and prevent laundry washing delay.

BACKGROUND ART

In general, a laundry treating apparatus may be classified into a washing machine and a drying machine based on a function of processing laundry. The washing machine performs a laundry washing cycle using water to remove contaminants from the laundry. The drying machine performs a drying cycle to remove moisture contained in the laundry. Recently, a washing and drying machine having integrated drying function and washing function has been developed.

In one example, the laundry treating apparatus may be classified into a top-loading type in which a laundry inlet for receiving laundry is defined in a top of a cabinet and a front loading type in which a laundry inlet for receiving laundry is defined in a front or side portion of a cabinet.

The top-loading type washing machine includes a cabinet forming an appearance, a drum, and a tub provided inside the cabinet. In this connection, in the top-loading type washing machine, the drum and tub extend in a perpendicular manner to a ground, and the drum rotates about a axis of rotation perpendicular to the ground. In addition, a top of the cabinet has a laundry inlet for receiving laundry. At the top of the cabinet, a door is disposed that opens and closes the laundry inlet.

When a spinning process is performed in such a top-loading type washing machine, a rotation speed of the drum may exceed about 1000 rpm depending on a machine. When spinning the laundry by rotating the drum at the high speed, the laundry inside the drum may be rotated at high speed while not being evenly spread. That is, the laundry in the drum may rotate at a high speed while being eccentrically arranged. In this case, the drum may hit the tub and the cabinet due to the eccentricity of the laundry in the process of rotating the drum at high speed. The impact generated by the collision between the laundry and the drum and tub can be transmitted to the cabinet, and thus the impact amount can separate the door from the cabinet or a top cover of the cabinet from the underlying cabinet.

Further, when washing laundry having a waterproofing fabric such as an outdoor clothes product, water may accumulate inside the waterproofing fabric. That is, when the outdoor clothes performs a function of a balloon containing water, the water inside the clothes may not escape to an outside. Hereinafter, a state in which water is trapped inside the laundry is called a water-trapping balloon. In particular, when spinning a drum containing laundry with the water-trapping balloon at a high speed in a spinning process, an eccentricity occurs in the laundry inside the drum as the water-trapping balloon is removed momentarily.

The eccentricity caused by the removal of the water-trapping balloon causes vibration in the drum rotation process. Due to this vibration, the drum may collide with the tub. In particular, although the eccentricity generated during the spinning process in which the drum rotates at high speed is small, the impact amount between the drum and tub may be increased due to the drum rotating at high speed. Thus, there is a risk that the door provided on the top cover is separated from the top cover or the top cover is separated from the cabinet due to the impact amount. In recent years, in order to solve the problems caused by the water-trapping balloon, a laundry treating apparatus to detect and remove the water-trapping balloon has been introduced. FIG. 1 illustrates a conventional method for controlling a laundry treating apparatus in which the apparatus may be capable of detecting and removing the water-trapping balloon. (a) of FIG. 1 shows a drum rpm of a conventional laundry treating apparatus over time in a spinning process. (b) in FIG. 1 illustrates a conventional method for controlling a laundry treating apparatus in which the apparatus may be capable of detecting and removing a water-trapping balloon in a spinning process.

Referring to (a) in FIG. 1, the conventional laundry treating apparatus detects a wet laundry amount wo when a spinning cycle starts, and then performs a first spinning step I for raising a drum rotation speed to a middle speed RPM and then stopping the rotation and, then, a second spinning step II to remove the moisture from the laundry by raising the drum rotation speed to a high speed RPM.

The conventional laundry treating apparatus detects a first laundry amount W1 during the first spinning step I. A second laundry amount W2 is detected during the second spinning step II. Then, a water-trapping balloon determination step is performed by calculating a moisture ratio and a dewatered ratio.

Referring to (b) of FIG. 1, in the water-trapping balloon determination step S45, the conventional laundry treating apparatus performs a moisture ratio determination step S45 and a dewatered ratio determination step S46.

The moisture ratio Rw refers to a moisture percentage in the laundry. A high moisture ratio laundry refers to laundry having a relatively high moisture content. The high moisture ratio laundry may be a laundry composed of cotton fabric such as a towel. To the contrary, low moisture ratio laundry means the laundry having relatively low moisture content.

That is, when the laundry contains a water-trapping balloon, the moisture ratio Rw will be high due to the water-trapping balloon formed inside the laundry. When the laundry does not contain a water-trapping balloon, the moisture ratio Rw will be low. Therefore, the moisture ratio Rw may be used to determine whether the laundry contains the water-trapping balloon.

In this connection, the moisture ratio may be measured as a ratio between a wet laundry amount wo and a dry laundry amount io. The moisture ratio determination step S45 refers to a step for determining whether the laundry is a low moisture ratio laundry having a low moisture ratio Rw. When, in the moisture ratio determination step S450, the laundry is determined to be a low moisture ratio laundry having a moisture ratio lower than a reference moisture ratio RWf, the apparatus may proceed immediately to a spinning step S40 to raise the drum rotation speed to the high speed RPM in the second spinning step. This is because the low moisture ratio laundry refers to laundry free of the water-trapping balloon.

Further, when in the moisture ratio determination step S45, it is determined that the laundry is a high moisture ratio laundry having a moisture ratio higher than the reference moisture ratio RWf, the apparatus may determine the presence of the water-trapping balloon and proceed to the dewatered ratio determination step S46.

The dewatered ratio Rs is defined as the ratio between a wet laundry amount W0 under a specific situation and a reference inertia value *?*W1 and W2 of the laundry as measured in a state in which a moisture is removed from the laundry by accelerating the drum to a reference RPM Rf.

When in determining the dewatered ratio Rs of the laundry, it is determined that the dewatered ratio Rs is higher than a reference dewatered ratio Rsf, the dewatered ratio determination step S46 determines that the laundry does not contain a water-trapping balloon. If the dewatered ratio Rs is lower than the reference dewatered ratio Rsf, the dewatered ratio determination step S46 determines that the laundry contains a water-trapping balloon.

Thus, the apparatus prevents excessive vibration by preventing the drum from rotating beyond a safety RPM in the second spinning step II when the laundry contains a water-trapping balloon. To the contrary, if the water-trapping balloon is not contained in the laundry, the apparatus rotates the drum at a high-speed RPM in the second spinning step II to completely remove moisture from the laundry.

However, the conventional laundry treating apparatus calculates the moisture ratio and the dewatered ratio through an initial step of the first spinning step and the second spinning step to detect whether there is a water-trapping balloon inside the laundry. There was a problem that the water-trapping balloons could not be detected quickly.

Therefore, there is a problem that the apparatus cannot immediately accelerate the drum at high speed because the apparatus does not determine surely whether there is a water-trapping balloon in the laundry in the first spinning step or a short spinning step.

Further, the conventional laundry treating apparatus decelerates the drum immediately after accelerating the drum in the first spinning step. Thus, there is no temporal section to maintain the rotational speed of the drum therebetween. This may reduce the dewatered ratio.

Furthermore, there was a problem that the dewatering efficiency is lowered because the drum is not accelerated at high speed in the first spinning step.

DISCLOSURE

Technical Problem

The present disclosure aims to provide a method and laundry treating apparatus for detecting, immediately at an initial step (short spinning step or first spinning step) of a spinning cycle, whether laundry contains a water-trapping balloon.

The present disclosure aims to provide a method and laundry treating apparatus for maximizing a spinning effect by continuously removing moisture from laundry during a process of detecting the water-trapping balloon.

The present disclosure aims to provide a method and laundry treating apparatus for accurately detecting presence or absence of a water-trapping balloon without measuring the moisture ratio and dewatered ratio.

The present disclosure aims to provide a method and laundry treating apparatus for accurately detecting presence or absence of a water-trapping balloon by measuring a current value generated when a drum is momentarily accelerated or decelerated while the drum rotates at a constant speed.

The present disclosure aims to provide a method and laundry treating apparatus for increasing a dewatering efficiency by accelerating the drum to a high speed or maintaining the drum rotation speed at the high speed at and from a beginning of the spinning cycle when no water-trapping balloon is detected.

The present disclosure aims to provide a method and laundry treating apparatus for increasing both a stability and a dewatering efficiency by varying the rpm of the drum depending on the presence or absence of the water-trapping balloon.

Technical Solution

One aspect of the present disclosure proposes a method for controlling a laundry treating apparatus, wherein the apparatus includes; a tub for storing water therein; a drum received in the tub to accommodate laundry therein; a driver coupled to the tub to rotate the drum; and a controller configured for detecting a current applied or measured to or in the driver, wherein the method includes: a first spinning step for rotating the drum at a first speed to remove moisture from the laundry; and a second spinning step for rotating the drum at a second speed higher than the first speed to remove moisture from the laundry, wherein the first spinning step includes: accelerating the drum's rotational speed to the first speed for a first time duration t1; maintaining the rotational speed of the drum at the first speed for a second time duration t2 larger than the first time duration t1; and when the second time duration t2 ends, increasing the drum's rotational speed from the first speed to a third speed higher than the first speed, or stopping the drum rotation.

In one implementation, the first spinning step includes: when a current value applied to or measured to or in the driver during the second time duration t2 when the drum rotates at the first speed increases, stopping the drum rotation; or when a current value applied to or measured to or in the driver during the second time duration t2 when the drum rotates at the first speed decreases or is maintained, increasing the drum rotation speed to the third speed.

In one implementation, the first spinning step includes: when a vibration level detected in the drum during the second time duration t2 when the drum rotates at the first speed increases, stopping the drum rotation; or when a vibration level detected in the drum during the second time duration t2 when the drum rotates at the first speed decreases or is maintained, increasing the drum rotation speed to the third speed.

In one implementation, the first spinning step includes: after maintaining the drum's rotational speed at the first speed for the second time duration t2, accelerating the drum to a fourth speed higher than the first speed and lower than the second speed, and then decelerating the drum back to the first speed.

In one implementation, the first spinning step includes: after accelerating the drum's rotational speed to the fourth speed and the decelerating the drum back to the first speed, increasing the drum's rotation speed to the third speed, or stopping the drum rotation.

In one implementation, the third speed is equal to the second speed.

In one implementation, when the first spinning step includes increasing the drum's rotational speed to the third speed, the first spinning step further includes maintaining the drum's rotational speed at the third speed for a third time duration t3 and then stopping the drum rotation.

In one implementation, when the second spinning step includes: when, in the first spinning step, the drum's rotational speed is increased to the third speed higher than the first speed, increasing the drum's rotational speed from the third speed to the second speed.

In one implementation, when the second spinning step includes: when, in the first spinning step, the drum's rotational speed does not reach the third speed and the drum rotation stops, preventing the drum from rotating at a speed beyond a safe speed lower than the second speed.

In one implementation, when the second spinning step includes: accelerating the drum's rotational speed to the first speed; maintaining the rotational speed of the drum at the first speed; and increasing the drum's rotational speed from the first speed to the second speed or stopping the drum's rotation.

In one implementation, when the second spinning step includes: when a current value applied to or measured in the driver during the second time duration t2 when the drum rotates at the first speed increases, preventing the drum from rotating at a speed beyond a safe speed lower than the second speed; or when a current value applied to or measured in the driver during the second time duration t2 when the drum rotates at the first speed decreases or is maintained, increasing the drum rotation speed to the second speed.

In one implementation, the second spinning step includes: when a vibration level detected in the drum during the second time duration t2 when the drum rotates at the first speed increases, preventing the drum from rotating at a speed beyond a safe speed lower than the second speed; or when a vibration level detected in the drum during the second time duration t2 when the drum rotates at the first speed decreases or is maintained, increasing the drum rotation speed to the second speed.

In one implementation, the first spinning step includes: accelerating the drum's rotational speed to a fourth speed higher than the first speed and then decelerating the drum rotation speed to the first speed; and then, accelerating the drum's rotation speed from the first speed to the second speed, or rotating the drum at a speed below the safety speed lower than the second speed.

Advantageous Effects

The present disclosure has an effect of detecting, immediately at an initial step (short spinning step or first spinning step) of a spinning cycle, whether laundry contains a water-trapping balloon.

The present disclosure has an effect of maximizing a spinning effect by continuously removing moisture from laundry during a process of detecting the water-trapping balloon.

The present disclosure has an effect of accurately detecting presence or absence of a water-trapping balloon without measuring the moisture ratio and dewatered ratio.

The present disclosure has an effect of accurately detecting presence or absence of a water-trapping balloon by measuring a current value generated when a drum is momentarily accelerated or decelerated while the drum rotates at a constant speed.

The present disclosure has an effect of increasing a dewatering efficiency by accelerating the drum to a high speed or maintaining the drum rotation speed at the high speed at and from a beginning of the spinning cycle when no water-trapping balloon is detected.

The present disclosure has an effect of increasing both a stability and a dewatering efficiency by varying the rpm of the drum depending on the presence or absence of the water-trapping balloon.

MODE FOR INVENTION

Figure 1:
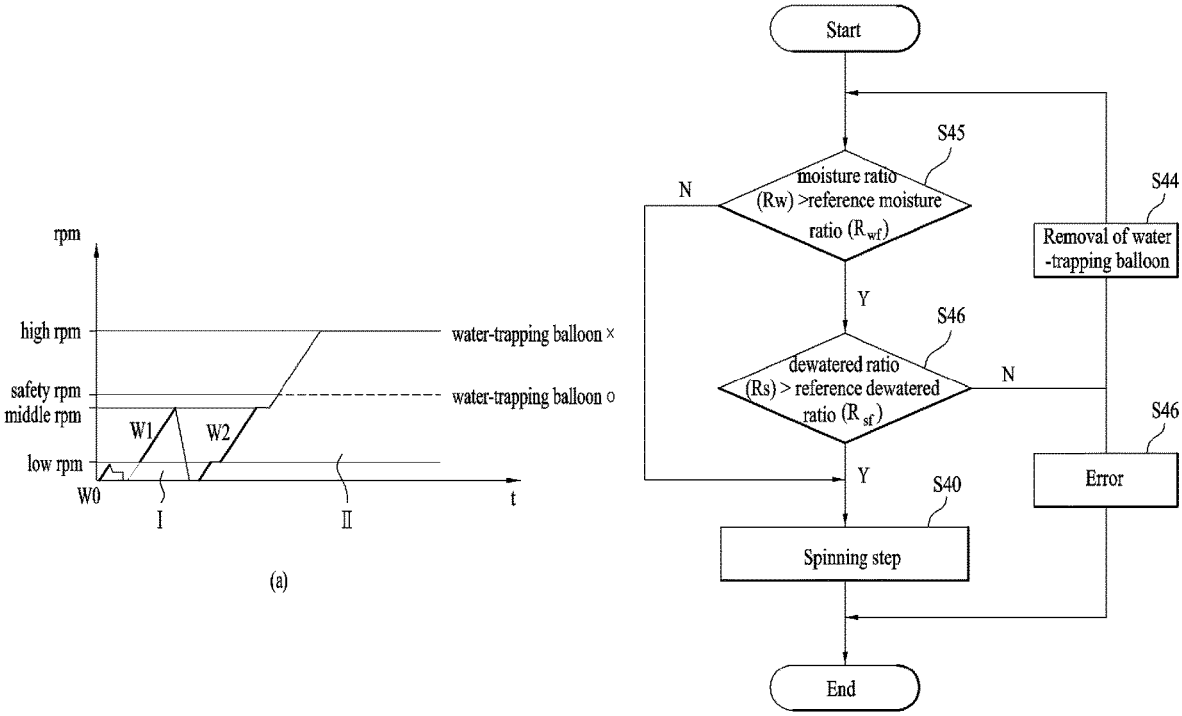
FIG. 1 illustrates a water-trapping balloon detection method by a conventional laundry treating apparatus.

Hereinafter, exemplary embodiments disclosed herein will be described in detail with reference to the accompanying drawings. Herein, the same or similar components in different embodiments are given the same or similar reference numerals. Only a first description thereof will be provided but a next description thereof will be omitted. As used herein, a singular forms "a", "an" and "the" include plural forms unless a context clearly indicates otherwise. Further, in describing embodiments disclosed herein, when it is determined that a detailed description of a well-known component may obscure a gist of the embodiments disclosed herein, the detailed description thereof will be omitted. Further, it should be noted that the accompanying drawings are provided only for easily understanding exemplary embodiments disclosed herein and are not to be construed as limiting a technical spirit disclosed in the present specification by the accompanying drawings.

Figure 2:
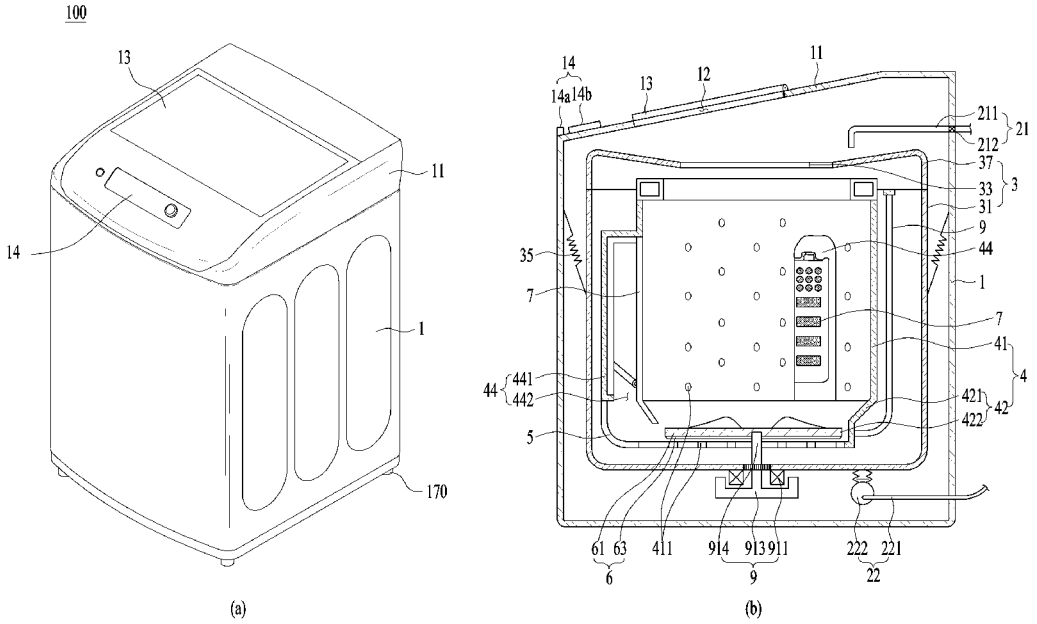
FIG. 2 illustrates a configuration of a laundry treating apparatus in accordance with the present disclosure.

FIG. 2 shows a structure of a laundry treating apparatus in accordance with the present disclosure.

(a) in FIG. 2 illustrates an appearance of the laundry treating apparatus in accordance with the present disclosure. (b) in FIG. 2 illustrates an internal configuration of the laundry treating apparatus in accordance with the present disclosure.

Referring to (a) in FIG. 2, the laundry treating apparatus 100 in accordance with the present disclosure may include cabinet 1 forming an appearance. The cabinet 1 has a laundry inlet 12 for receiving laundry to be input into a drum or for withdrawing laundry stored in the drum, and a door 13 for opening and closing the laundry inlet 12.

In this connection, when the laundry treating apparatus 100 in accordance with the present disclosure is a top load type laundry treating apparatus having a laundry inlet 12 defined in a top of the cabinet, the cabinet 1 may further have a top panel 11 which forms a top face of the laundry treating apparatus. The top panel 11 may be in combination with the cabinet 1. The top panel 11 has the laundry inlet 12 defined therein. A door 13 may be coupled to the top panel.

Referring to (b) in FIG. 2, the laundry treating apparatus 100 in accordance with the present disclosure may include a tub 3 provided inside the cabinet to store water therein and a drum 4 provided inside the tub to store laundry therein.

In one example, the present disclosure does not exclude an embodiment in which the laundry treating apparatus is of a front load type in which the laundry inlet 12 is provided in a front portion of the cabinet 1.

The top panel 11 may extend in parallel to the ground. Further, as shown in FIG. 2, the top panel 11 may extend in an inclined manner. The top panel 11 may extend in an inclined manner so that a rear portion of the cabinet 1 is higher than a front portion thereof. This increases a volume of a top region of *?*the cabinet 1 to provide a space for various components such as a water supply 21 inside the cabinet 1, while allowing the user to easily access a laundry inlet 33 of the tub 3.

In a front portion of the top panel 11, a control panel 14 for controlling operations of the laundry treating apparatus may be disposed. The control panel 14 may include a display 14*b* displaying a current state of the laundry treating apparatus. Specifically, the control panel 14 may include the display 14*b* for displaying a state of the laundry treating apparatus and an input interface 14*a* for receiving an operation command to the laundry treating apparatus from the user. The display 14*a* may be embodied as a liquid crystal display. The input interface 14*b* may be embodied as a button or a touch panel.

The tub 3 housed inside the cabinet 1 includes a tub body 31 which provides a space for water storage and a tub laundry inlet 33 defined in a top of the tub body 31 and communicating with the laundry inlet 11. Further, the tub 3 may include a tub cover 37 to prevent backflow and outflow of water contained in the tub 3. The tub cover 37 is provided on a top of the tub body 31 and the tub laundry inlet 33 is defined along an inner circumferential face thereof.

The tub body 31 may be secured to the cabinet 1 via a tub support 35. The tub support 35 is composed of a spring, damper, and the like to damp vibration of the tub 3. The tub body 31 may receive water from a water supply 21 and store the water therein. The water supply 21 may include a water supply pipe 211 connected to an external water supply, and a water supply valve 212 that regulates a flow rate of water moving in the water supply pipe 211 by adjusting an opening degree of the water supply pipe 211. Further, although not shown, the water supply pipe 211 may include a cold water pipe and a hot water pipe.

The water supply pipe 211 may extend from the water supply valve 212 to the tub laundry inlet 33 and may be in communication with one side of the tub cover 37 or one side of the tub body 31. That is, the water supply pipe 211 may be provided in any shape and structure as long as the pipe 211 can supply water to the tub 3.

The water stored in the tub 3 is discharged to the outside of cabinet 1 via a water discharge unit 22 including a water discharge pipe 221 directing the water inside the tub 3 to the outside of the cabinet 1 and a water discharge pump 222.

Although not shown, the water discharge pipe 221 may extend in a predetermined length from a bottom of the tub 3 to a top of the tub 3 so that the tub 3 can store water therein. The tub 3 may be provided with a level sensor 9 for measuring a water level in the tub 3.

The drum 4 may include a drum body 41 providing a space in which laundry is stored, and a drum base 42 constituting a bottom of the drum 4. The drum body 41 may have a drum laundry inlet 43 communicating with the tub laundry inlet 33.

The drum body 41 and the drum base 42 may be rotatably provided inside the tub 3. An inner circumferential face of the drum body 41 and the drum base 42 may have a plurality of through-holes 411 defined therein for introducing water into the tub 4 into the drum 4.

In one example, the inner circumferential face of the drum body 41 has a water channel 44 defined therein to move the water from the bottom of the drum 5 to the top of the drum 5. That is, the water channel 44 may extend from the drum base 42 to a predetermined vertical position of the inner circumferential face of the drum body 41.

The water channel 44 includes a water channel body 411 having a flow path defined therein for moving water near the drum base 42 to the top of the drum body 41, and a water inlet 442 defined in a bottom of the water channel body 441 and receiving the water inside the drum 4. In this connection, the water channel body 441 may be constructed such that the flow path along which water introduced thereto from the bottom of the drum 4 flows to the top of drum 4. In another example, the water channel body 441 may be embodied as a housing form having an opening toward the drum body 41.

The water channel body 441 may be provided on an outer wall of the drum body 41, and extend from the drum base 42 along the inner peripheral surface of the drum body 41 to the top thereof.

The water channel body 441 is constructed as an outer wall of the drum body 41. One face of the water channel body 441 may define one outer face of the drum body 41.

The drum 4 may further include a cut portion 423 passing through the drum base 42 to deliver water contained in the drum 4 to the water channel 44. As a result, the water inside the drum 4 may flow through the cut portion 423 and flow into the inlet 412 of the water channel 44. That is, the water inside the drum 4 may flow out of the drum body 41 and flow back into the water channel 44 provided in the drum body 41.

In one example, the water channel 44 may include a filtering portion 7 for filtering the water introduced into the water channel 44 and then discharging the filtered water back to the drum. Since the filtering portion 7 has to discharge the water introduced into the water channel 44 back to the drum 4, the filtering portion 7 is disposed on one face of the water channel body 441 facing the drum body 41.

Further, the filtering portion 7 may define one face of the water channel body 411, and may be provided as a separate member from the water channel body 441 and may be attachable or detachable to or from the water channel 44. As a result, the filtering portion 9 may define an inner circumferential face of the drum body 41. When water in a lower space of the drum 4 flows into the water channel 44, and is discharged to the filtering portion 7, foreign matter contained in the water contained in the drum 4 may be removed by the filtering portion 7.

In one example, the drum 4 may include a water-flow generation mechanism 6 that generates a pressure and a water flow for flowing water out of the drum 4 into the cut portion 423 and then to the water channel 44.

The water-flow generation mechanism 6 may be rotatably provided on the drum base 42 and may rotate separately from the drum 4. The water-flow generation mechanism 6 may rotate on the drum base 42 to form a stream of water, allowing a portion of the water of the drum 4 to flow out to the cut portion 423. The water-flow generation mechanism 6 may include a disk-shaped water-flow generation body 61 accommodated in the drum base 42, agitating blades 62 protruding from a top of the water-flow generation body 61 and radially extending from the water-flow generation body 61, and pumping blades 63 protruding from a bottom of the water-flow generation body 61 to push the water out of the drum base 42. In this connection, in order to induce stable rotation of the water-flow generation mechanism 6, and to minimize interference with the drum base 42, a length of each of the agitating blades 62 and the pumping blades 63 may be smaller than a diameter of the water-flow generation body 61. The agitating blades 62 of the water-flow generation mechanism 6 serves to transfer a mechanical force to the laundry contained within the drum 4 or to create a water stream inside the drum body 41 to improve washing power.

Further, the pumping blade 63 of the water-flow generation mechanism 6 may serve to introduce the water contained in the drum 4 into the water channel 44 to circulate the water in the drum 4. The water-flow generation mechanism 6 may be rotated by a driver 9. The driver 9 may include a stator 911 which is fixed to an outer face of the tub body 31 and generates a rotating magnetic field, a rotor 913 rotatable by the rotating magnetic field from the stator 911, and a rotatable shaft 914 penetrating a bottom of the tub body 31 and connecting the water-flow generation mechanism 6 with the rotor 913.

When the water-flow generation mechanism 6 is rotated by the driver 9, the water stored in the drum 4 can move along the direction of rotation of the agitating blades 62 and pumping blades 63. In this connection, the driver 9 is preferably provided below the tub 3 because the water-flow generation mechanism 6 is provided on the drum base 42.

In one example, the drum 4 may further include a guide 5 provided on an outer wall of the drum 4 to guide the water flowing out of the drum 4 by the water-flow generation mechanism 6 to the water channel 44. That is, the drum 4 and the water channel 44 may communicate with other through the guide 5.

Figure 3:
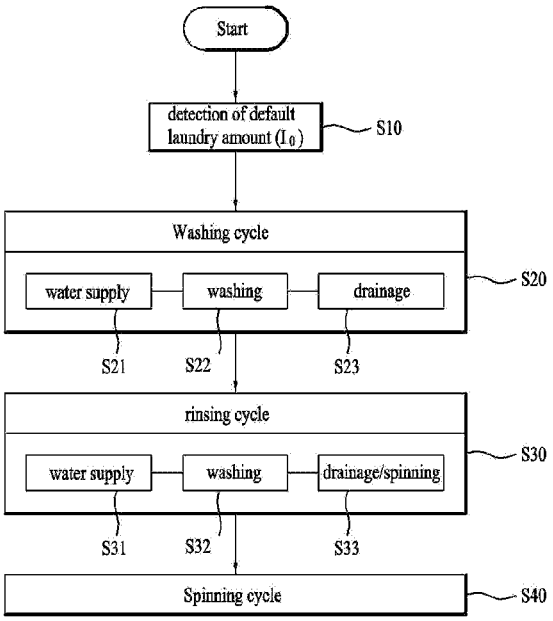
FIG. 3 illustrates a laundry washing process by a laundry treating apparatus in accordance with the present disclosure.

FIG. 3 illustrates an operating process of the laundry treating apparatus in accordance with the present disclosure.

Referring to FIG. 3, a method for controlling the laundry treating apparatus in accordance with the present disclosure includes a washing cycle S20 for washing contaminated laundry using a detergent, a rinsing cycle S30 for removing the detergent from the laundry for which the washing cycle S20 is completed, and a spinning cycle S40 to remove moisture from the laundry for which the rinsing cycle S30 is completed.

The washing cycle S20 refers to a cycle for separating contaminants from contaminated laundry using water. In detail, the washing cycle S20 may include a water-supply step S21, a washing step S22, and a drainage step S23. In the water-supply step S21, water is supplied from a water-supply source to supply water to the tub. The washing step S22 refer to a step of removing the contaminants from the laundry by rotating the drum. In the washing step S22, the drum may remove the contaminants from the laundry while rotating forwardly or reversely. In addition, detergent may be supplied into the drum in the washing step S22. The detergent is used to separate contaminants from the laundry. When the washing step S22 is completed, the drainage step S23 for discharging water to the outside of the washing machine is performed. In the drainage step S23, the water in the tub may be discharged to the outside using a drainage pump. In the washing cycle S20, the water-supply step S21, the washing step S22, and the draining step S23 may be performed one or more times. The number of times the water-supply step S21, washing step S22 and drainage step S23 are repeated may vary according to the laundry amount or the degree of contamination of the laundry.

The rinsing cycle S30 refers to a cycle for removing detergent and contaminants from the laundry for which the washing cycle S20 is completed. Specifically, the rinsing cycle S30 includes a water-supply step S31, a rinsing step S32, and a drainage/spinning step S33. In the water-supply step S31, water is supplied from a water-supply source to supply water to the tub. The rinsing step S32 refers to a step of removing the detergent and contaminants from the laundry by rotating the drum. In the rinsing step S32, the drum can separate detergents and contaminants from the laundry while rotating forwardly or reversely. In addition, a softening agent may be supplied into the drum in the rinsing step S32. The softening agent prevents static electricity from occurring in the laundry and softens the laundry. When the rinsing step S32 is completed, the drainage step S33 for discharging water to the outside of the washing machine is performed. In the draining/spinning step S33, water in the tub may be discharged to the outside using a drain pump. When the drainage is completed, spinning of the drum may be carried out to discharge foreign matters and detergents remaining in the laundry to the outside together with moisture.

In the rinsing cycle S30, the water-supply step S31, the rinsing step S32 and the draining/spinning step S33 may be carried out at least once. The number of times the water-supply step S31, rinsing step S32 and drainage step S33 are repeated may vary depending on the laundry amount or the degree of contamination of the laundry.

The spinning cycle S40 refers to a cycle to remove moisture from the laundry. In the spinning cycle S40, the drum is rotated at a high speed to remove moisture from the laundry using a centrifugal force. The spinning cycle S40 will be described later.

The method for controlling the laundry treating apparatus in accordance with the present disclosure may further include a default laundry amount detection step S10 for detecting a laundry amount in the drum 4 before the user selects a washing course, etc. via the control panel 14 and thus the washing cycle S10 is performed.

The default laundry amount detection step S10 refers a step for detecting the laundry amount in the drum 4. A scheme of detecting the laundry amount may be implemented in various ways.

Figure 4:
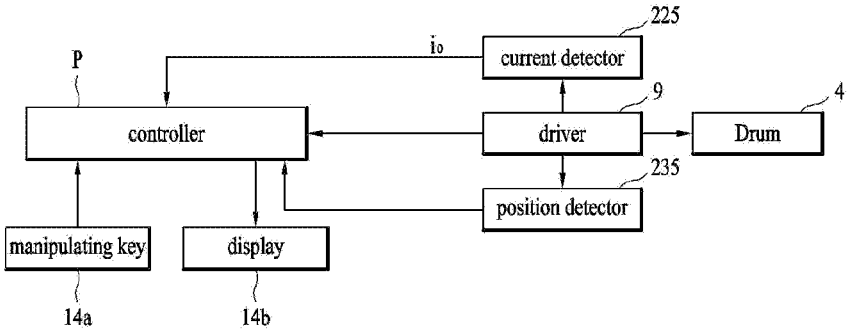
FIG. 4 is a block diagram of detecting a laundry amount and a water-trapping balloon in laundry using a driving unit of a laundry treating apparatus in accordance with the present disclosure.

FIG. 4 illustrates a structure in which the laundry treating apparatus can detect the laundry amount and eccentricity or unbalance, and vibrations of the laundry using a current value or a voltage of a driver.

Referring to FIG. 4, in the laundry treating apparatus 100 according to the present disclosure, the driver 9 is controlled by a control operation of a controller P such that the driver 9 rotates the drum 4. The controller P receives an operation signal or a control command from the input interface 14*a*. The input interface 14*a* may have a washing course and a selection option for performing the washing, rinsing and spinning cycles. Accordingly, the washing, rinsing, and spinning cycles can be performed.

Further, the controller P may control the display 14*b* to display a washing course, a washing time, a spinning time, a rinsing time, or a current operation state thereon.

In one example, the controller P controls the driver 9 to not only rotate the drum 4 but also to control the rotation speed of the drum 4. The controller P may control the driver 9 using a current detector 225 detecting an output current flowing in the driver 9 and a position detector 220 detecting a position of the driver 9.

The current detected by the driver 9 and the detected position signal may be input to the controller 210.

In one example, the laundry treating apparatus in accordance with the present disclosure omits the position detector 235, but may implement a separate algorithm such that a location of the driver 9 can be detected. In other words, a sensorless driver 9 can detect the position of the rotor or stator in the driver 9 by measuring the current or voltage output from the driver 9.

Hereinafter, referring to FIG. 5, a method for controlling the laundry treating apparatus in accordance with the present disclosure which may have the above configuration and may configure a spinning process based on detecting of the water-trapping balloon will be described.

When the spinning cycle 40 starts or a spinning starts in the rinsing cycle 30, the laundry treating apparatus according to the present disclosure performs a first spinning step I to remove the moisture of the laundry by rotating the drum at a middle speed rpm or a first speed and a second spinning step II to remove the moisture of the laundry by rotating the drum at a high speed rpm or a second speed faster than the middle speed rpm to remove the moisture of the laundry.

That is, the laundry treating apparatus according to the present disclosure performs the first spinning step I as a short spinning step for preliminarily rotating the drum at a middle rotation speed lower than the high speed rpm, and, then, performs the second spinning step II as a main spinning step for rotating the drum at a high speed rpm to remove a large amount of moisture in the laundry. Thus, before performing the second spinning step II, the laundry treating apparatus according to the present disclosure accelerates the drum in the first spinning step I to check whether excessive unbalance or vibration occurs in the acceleration process.

The first spinning step I is configured to check the presence or absence of vibration generated in the acceleration process due to the eccentricity of the laundry. In this connection, the middle speed RPM is preferably set to a lower rpm than the rpm at which resonant vibrations occur.

When washing a laundry made of waterproof fabrics, water may accumulate inside the laundry. The water penetrated into the laundry during the washing process should be discharged through the spinning cycle S40. However, water may remain in the laundry during the spinning cycle S40 due to the waterproof function of the laundry. That is, there is a case where the laundry having waterproof function performs a function of a balloon, such as when water is contained in the inside of the balloon, and the water therein does not escape to the outside. Hereinafter, a state in which water is accumulated in a predetermined amount or more inside the laundry is called a 'water-trapping balloon'. In particular, in the spinning cycle S40, when rotating the drum 4 accommodating therein laundry having the water-trapping balloon at the high speed, the laundry inside drum 4 is eccentric as soon as the water-trapping balloon is removed.

Therefore, the laundry treating apparatus according to the present disclosure performs a wet laundry amount sensing step wo process for measuring a wet laundry amount of the drum 4 in the state when the laundry contains the water-trapping balloon when detecting the eccentricity in an initial spinning process, and upon detecting the eccentricity, for removing the eccentricity. In the wet laundry amount detection step, the apparatus may rotate the drum at a low speed rpm, and then measure the amount of current applied to the driver 9, thereby to detect the wet laundry amount of the laundry accommodated in the drum based on the current amount. The low speed rpm may be defined as the rpm at which laundry starts to stick to the drum's inner wall. However, even when the eccentricity is removed, the water-trapping balloon may not be removed due to the arrangement of the laundry. That is, the controller of the washing machine proceeds to the spinning process while recognizing that there is no eccentricity inside the drum based on the arrangement of the laundry even when the water-trapping balloon is contained therein. If the spinning is in this state, the eccentricity is caused by the removal of moisture from the laundry except the water-trapping balloon. Further, when the water-trapping balloon bursts during spinning, serious eccentricity may occur momentarily inside the drum.

This causes severe vibration and noise. In severe cases, vibration may cause the drum 4 to collide with the tub 3. In particular, although the eccentricity generated during the spinning process in which drum 4 rotates at the high speed is small, the impact amount between the drum 4 and tub 3 can be increased due to the drum 4 rotating at the high speed. Thus, there is a risk that the door provided on the top cover is separated from the cover or the top cover is separated from the cabinet by the impact amount.

Thus, so as to prevent the water-trapping balloon from bursting in the first spinning step I, the middle speed rpm may be set at a lower rpm than a safety rpm at which the water-trapping balloon can burst by the centrifugal force. For example, the middle speed RPM may be in a range of 400 to 450 rpm. Further, the high speed rpm may be set to an rpm at which the apparatus rotates the drum as quickly as possible when the laundry treating apparatus performs the spinning cycle. For example, the high speed rpm may be 1000 rpm or greater.

The laundry treating apparatus according to the present disclosure may detect a water-trapping balloon not detected in the eccentric sensing step WO in the first spinning step I.

Specifically, the first spinning step I includes a first rising step A1 which the controller accelerates the drum to the middle speed rpm or first speed for a first time duration, a first maintaining step A2 which the controller maintains rotation of the drum at the first speed constantly for the second time duration, and a first water-trapping balloon detection step A3 to detect unbalance of the drum in the first maintenance step or measure the amount of current applied to the driver to determine whether the laundry accommodated in the drum contains a water-trapping balloon based on the detection result.

When the drum is rotated at a constant speed at the first speed, the laundry can be attached to the inner wall of drum 5 because the first speed is higher than the low speed rpm.

In this connection, at an initial point of the first maintenance step A2, the laundry contains a large amount of moisture, so that the laundry volume is relatively large. Thereafter, when the first maintenance step A2 is continued, the moisture contained in the laundry is discharged to a certain amount outside the drum 5 and thus the volume of the laundry begins to decrease. Therefore, the laundry inside the drum is gradually attached to the inner wall of the drum 5 and becomes thinner. As a result, the diameter of an inner wall of the laundry is reduced from D1 to D2.

In one example, the laundry such as outdoor clothes may be made of water-proof fabric. In this case, when the laundry has the water-trapping balloon, the impact of the water-trapping balloon on the drum may be slight because the laundry contains a large amount of moisture in a beginning point of the first maintenance step A2.

However, when the first maintenance step A2 proceeds, the laundry continues to spin, thereby having the reduced volume and becoming thinner. In one example, the water in the water-trapping balloon is present inside the laundry as it is not discharged outside the drum 5. Eventually, as the first maintenance step A2 progresses, the water-trapping balloon will begin to invade into other types of laundry.

As a result, the drum 5 vibrates whenever the water-trapping balloon is rotated. As other types of laundry becomes thinner or lighter, the vibration will increase.

Therefore, when, in the first water-trapping balloon detection step A3, the unbalance of the drum continues to increase or exceeds a reference value in the process in which the drum rotates at the first speed, the controller of the apparatus may determine that the water-trapping balloon exists in the laundry.

Therefore, the apparatus may accurately detect the presence or absence of a water-trapping balloon by detecting the unbalance or the amount of change in the unbalance in the first maintaining step A2, even without calculating the moisture ratio or the dewatered ratio of the laundry.

Further, the laundry treating apparatus according to the present disclosure may not only detect the water-trapping balloon but also perform the laundry spinning by maintaining the drum ration speed at the first speed in the first maintaining step A2 in the first spinning step I. Therefore, this may maximize the spinning efficiency while the duration of the second spinning step II can be reduced, resulting in the effect of preventing the laundry washing delay.

Further, the laundry treating apparatus according to the present disclosure can detect that there is no water-trapping balloon in the first spinning step I corresponding to the short spinning step even without performing the second spinning step II. Therefore, if the water-trapping balloon is not detected in the first water-trapping balloon detection step A3, the controller may perform a rapid acceleration step A4-1 to accelerate the drum to a third speed faster than the first speed. The third speed may correspond to a speed higher the safety RPM and may be equal to the second speed. As a result, the laundry treating apparatus according to the present disclosure can effectively remove moisture in the laundry even in the first spinning step I.

At the same time, in order to maximize the efficiency of the first spinning step I, the controller of the apparatus may perform, after the rapid acceleration step A4-1, a spinning enhancing step A4-2 which the controller maintains the drum rotation speed at the third speed for a certain time, and a first stopping step A4-3 in which the drum is decelerated and stopped. That is, maintaining the RPM of the drum at the third speed higher than the safety RPM in the spinning enhancing step, may more effectively remove the moisture of the laundry.

However, if the water-trapping balloon is detected in the first water-trapping balloon detection step A3, the laundry treating apparatus according to the present disclosure may immediately perform the first stopping step A4-3. Then, the drum can be rotated in a left and right manner to be agitated to remove the water-trapping balloon.

Further, the controller may save the presence of the water-trapping balloon and may perform a speed limiting step A8-2 to prevent the drum from rotating at a speed higher than the safety rpm lower than the second speed in the second spinning step.

The presence of the water-trapping balloon indicates the presence of the water-proof clothes. Therefore, even if the water-trapping balloon is removed before the second spinning step II, the water-trapping balloon may occur again. Thus, in the second spinning step II, the speed of the drum may be limited to the safety RPM to prevent the water-trapping balloon from bursting.

In one example, if the water-trapping balloon is not detected in the first water-trapping balloon detection step A3, the second spinning step II may perform a high speed step A8-1 to accelerate the drum to the second speed. This can reliably remove the moisture of the laundry.

Figure 6:
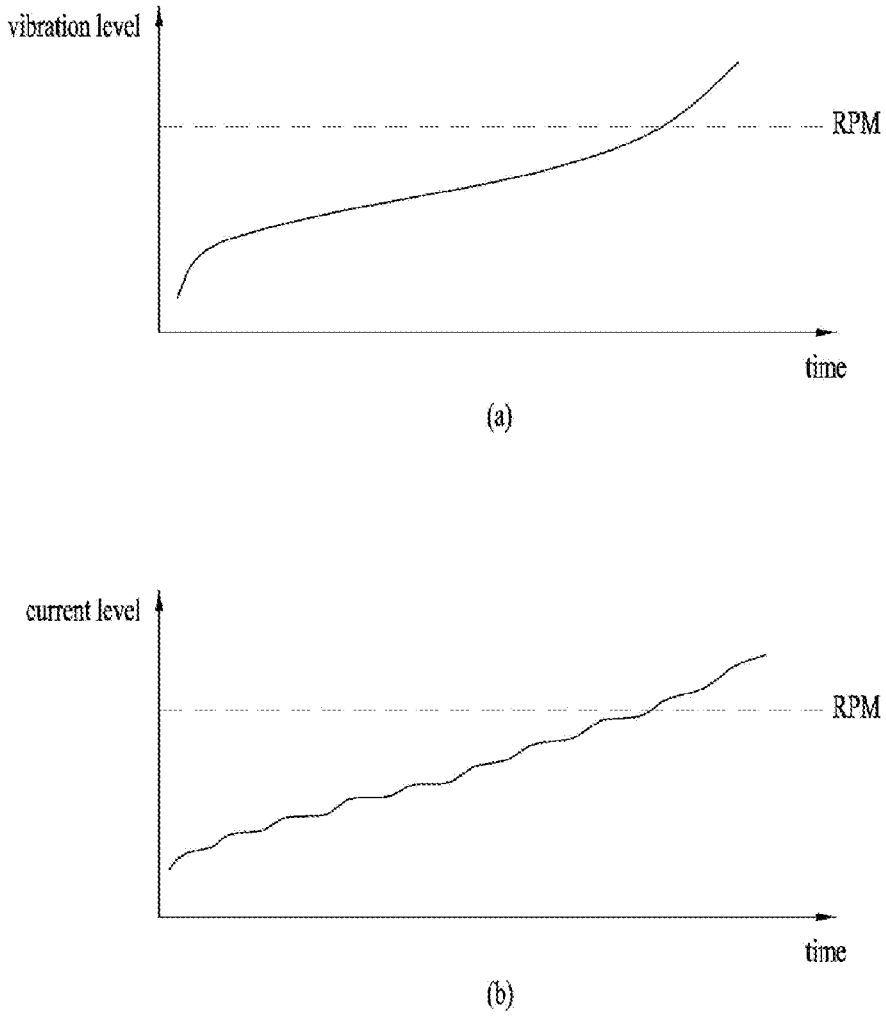
FIG. 6 shows change in a vibration value and a current value based on presence or absence of the water-trapping balloon.

FIG. 6 shows changes of the vibration amount and the current value over time in the first maintaining step A2.

Referring to FIG. 6*a*, if the water-trapping balloon is not inside the drum 4, the laundry is evenly attached to the drum's inner wall over time, thus reducing the eccentricity. Therefore, initially the drum rotates abruptly, such that the inertia force acts on the laundry and thus the vibration amount increases. However, then, the vibration amount is maintained or decreased over time.

However, if the water-trapping balloon is located inside the drum 4, the water drains out of the laundry over time, but the water inside the water-trapping balloon is collected to one site. Therefore, initially, the eccentricity due to the water-trapping balloon is low due to the weight of the laundry and the weight of moisture contained in the laundry. Then, over time, the weight of the laundry decreases, thus increasing the eccentricity due to the water-trapping balloon. Therefore, the vibration amount of drum 4 gradually increases.

Referring to FIG. 6*b*, if there is no water-trapping balloon, the degree of eccentricity decreases as time goes by, such that so much energy is not needed to keep the drum rotating continuously. Therefore, the current value applied to the driver may be constantly maintained or decreased.

However, if there is present the water-trapping balloon, the eccentricity increases over time. As the eccentricity increases, the current value increases because more energy is required to rotate the water-trapping balloon. Specifically, a peak value of the current value and a voltage value will become larger and larger.

Therefore, in the first maintaining step A2, the presence or absence of a water-trapping balloon can be detected by detecting a change in the current value or vibration value inside the drum using the driver and a vibration sensor.

The control method shown in FIG. 5 may be summarized with reference to the rotation speed of the drum as follows.

The first spinning step I accelerates the drum's rotational speed to the first speed for the first time duration t1, and maintains the rotational speed of the drum for a second time duration t2 longer than the first time duration t1, and, then, when the second time duration t2 ends, increases the drum rotation speed from the first speed to the third speed higher than the first speed, or stops the drum rotating.

A reference factor used to increase or stop the drum speed may be the current value or the vibration value.

Specifically, the first spinning step I stops the drum rotation when the current value applied or measured to or in the driver increases during the second time t2 when the drum rotates at the first speed. To the contrary, if the current value applied or measured to or in the driver is maintained or decreased during the second time t2 when the drum rotates to the first speed, the first spinning step I increase the drum's rotational speed to the third speed.

In one example, the first spinning step I stops the drum's rotation if the vibration detected in the drum rises during the second time t2 when the drum rotates at the first speed. If the vibration detected in the drum is maintained or decreased during the second time t2 when the drum rotates to the first speed, the first spinning step I may increase the drum's rotational speed to the third speed.

In one example, the second speed and the third speed may be the same. In another example, the third speed may be higher than the second speed.

After the first spinning step I has increased the drum's rotational speed to the third speed, the first spinning step I may maintain the rotation speed of the drum at the third speed for a third time duration t3, and then stops the rotation of the drum.

The third time duration t3 may be longer than first time duration t1 and shorter than the second time duration t2. Thus, the spinning effect of the laundry can be maximized.

Figure 7:
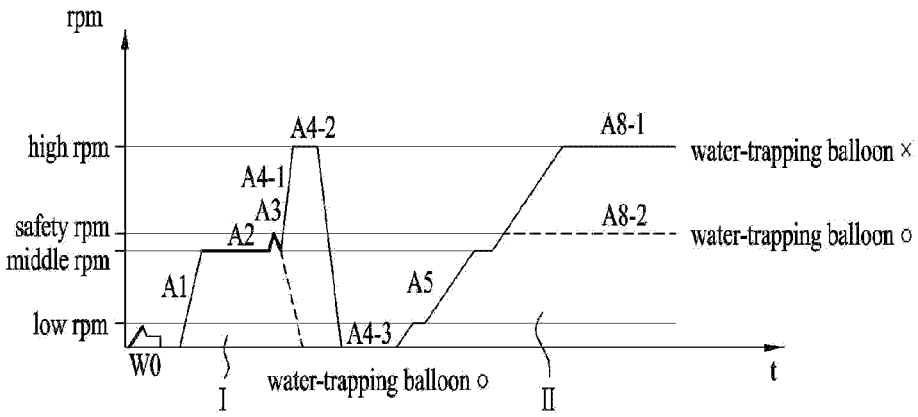
FIG. 7 illustrates a second embodiment of a spinning process in which a water-trapping balloon is detected and removed by a laundry treating apparatus in accordance with the present disclosure.
Figure 7:
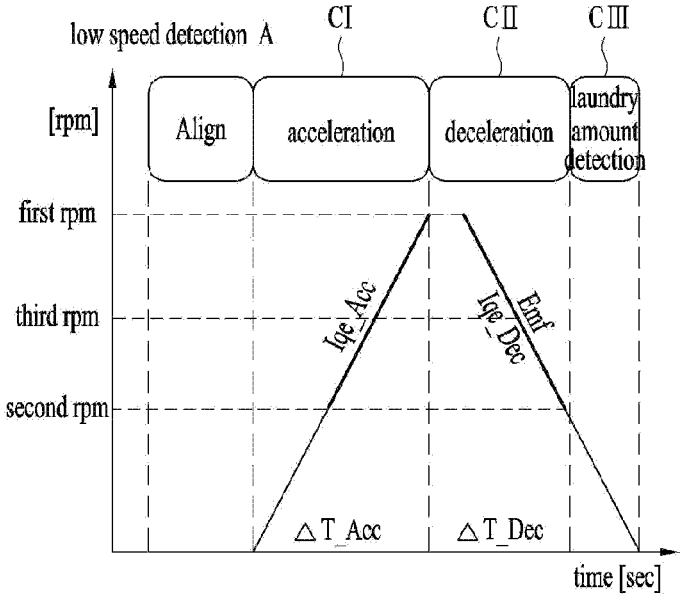

FIG. 7 illustrates another embodiment of the water-trapping balloon detection step A3 in accordance with the present disclosure.

Figure 5:
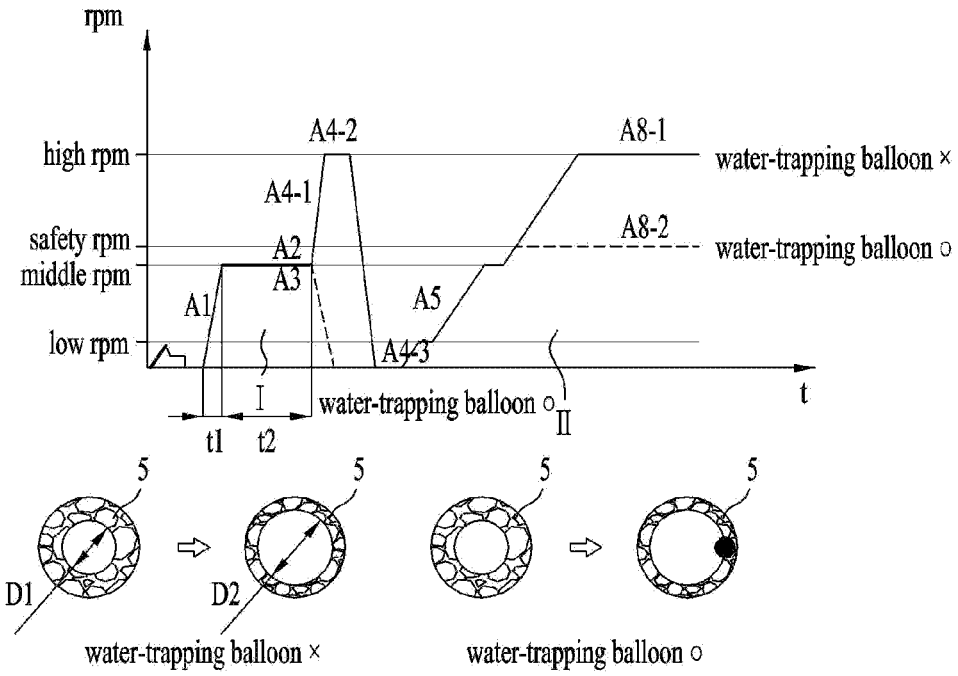
FIG. 5 illustrates a first embodiment of a spinning process in which a water-trapping balloon is detected and removed by a laundry treating apparatus in accordance with the present disclosure.

Referring to FIG. 7*a*, this embodiment may be the same as the embodiment of the method for controlling the apparatus in FIG. 5 except for the water-trapping balloon detection step A3.

The laundry treating apparatus according to the present disclosure may detect a water-trapping balloon by detecting at least one of a moisture ratio and a dewatered ratio, in addition to detecting a water-trapping balloon by detecting an unbalance or an eccentric change of a drum.

Specifically, if the moisture ratio is above a reference moisture ratio and the dewatered ratio is lower than a reference dewatered ratio, the controller may determine that the laundry contains the water-trapping balloon.

That is, when the laundry amount detected in the spinning step is defined as detected laundry amount WC, the moisture ratio may be defined as (the detected laundry amount/a reference laundry amount as a dry laundry amount). The dewatered ratio may be defined as (the detected laundry amount WC/a wet laundry amount Wo).

In this connection, a reference moisture ratio Rwf refers to a moisture ratio when a water-trapping balloon is present in the laundry. The reference dewatered ratio Rsf refers to a dewatered ratio when the water-trapping balloon is present in the laundry.

Thus, a high moisture ratio means that laundry contains much water. If the moisture ratio is above the reference moisture ratio, this means that too much water is contained in the laundry so that a water-trapping balloon is created in the laundry.

Further, a higher dewatered ratio means that more water has been discharged from laundry. If the dewatered ratio is below the reference dewatered ratio, this means that there is too much water in the laundry so that a water-trapping balloon is created in the laundry.

The reference moisture ratio and reference dewatered ratio may be based on the water-proofing clothes. That is, since the water-proof cloth has a moisture ratio and a dewatered ratio smaller than those of the cotton fabric, the moisture ratio and dewatered ratio may be easily determined in the presence of the water-trapping balloon. However, a general clothes such as cotton may be used as a reference.

As a result, in order to accurately determine the moisture ratio and dewatered ratio, it is very important to accurately measure the detected laundry amount wc before or during the spinning step.

To this end, the water-trapping balloon detection step A3 in another embodiment of the present disclosure includes a momentary acceleration step CI of accelerating the drum 4 from the first speed to a fourth speed faster than the first speed in the first maintaining step A2, and a momentary deceleration step CII to decelerate the drum to first speed in the first maintaining step A2, and a calculation step CIII which measures whether the laundry contains the water-trapping balloon by measuring an acceleration current value of the driver in the momentary acceleration step and a deceleration current value of the driver in the momentary deceleration step.

The calculation step CIII calculates at least one of the moisture ratio or the dewatered ratio of the laundry in progress of the maintaining step A2 by detecting the laundry amount wc of the laundry using the acceleration current value and the deceleration current value.

Referring to FIG. 7*b*, the detection method of the laundry amount wc by the laundry treating apparatus according to the present disclosure will be described.

The laundry treating apparatus according to the present disclosure detects a measurement value measured by the driver 9 or a command value applied to the driver 9 while accelerating the driver 9. The laundry treating apparatus according to the present disclosure detects a measured value measured by the driver 9 or a command value applied to the driver 9 while decelerating the driver 9. Thereafter, the laundry amount is calculated based on the measurement value or command value.

Specifically, the command value may be a current command value or voltage command value derived from the controller P and applied to drive the driver 9. The measurement value may be the current value or the voltage value of the driver 9 measured by a position detection unit 235 or a current detection unit 225 (Refer to FIG. 4).

If the controller P uses the command value to detect the laundry amount, an advantage thereof is that the controller P does not need to receive a feed-back of an actual situation from the driver 9 or to consider the actual driving situation of the driver 9. Therefore, calculating the laundry amount value can be simple and easy. Since the calculation is simplified, the laundry amount can be obtained quickly.

Therefore, the acceleration measurement value includes an acceleration current value Iq_ACC measured in the driver 9, and the deceleration measurement value may include a deceleration current value Iq_DEC measured in the driver 9. Specifically, the acceleration current value includes a current command value Iq*_ACC for rotating the driver during the acceleration step. The deceleration current value may include a current command value Iq*_DEC for rotating the driver during the deceleration step.

In one example, if the controller P uses the measurement value for detecting the laundry amount, the controller may reflect the actual situation of the driver 9 as it is, so that the laundry amount can be obtained accurately. The command value is generated only when the driver 9 is driven or powered and thus actively controlled. Therefore, the use of the measurement value has the advantage that data for detecting the laundry amount can be obtained even when the driver 9 is powered off or the driver 9 is not actively controlled.

In this manner, the controller can detect the laundry amount using a following formula:

Laundry amount (inertia, $Jm$, and Load_data) =

$$\frac{3}{2}\frac{P}{2}k_e\frac{i_q^{Acc}-i_q^{Dec}}{\Delta\omega_m^{Acc}/\Delta t_{Acc}-\Delta\omega_m^{Dec}/\Delta t_{Dec}}$$

where, the P and Ke are constant values of the driver 9 itself, and may be measured by the controller P. The denominator corresponds to a difference between a speed change at the acceleration step and a speed change at the deceleration step.

The speed change may be detected immediately by the controller P via the position detection unit 235, or may be detected by the controller P calculating a time duration consumed until the target acceleration or deceleration, or by the controller P measuring the current.

Therefore, the controller in accordance with the present disclosure can immediately calculate the laundry amount value only by measuring the acceleration output current value Iq_ACC at the time of acceleration and the acceleration output current value Iq_DEC at the time of deceleration. That is, the acceleration current value includes the acceleration output current value Iq_ACC output from the driver during the acceleration step.

The deceleration current value includes the deceleration output current value Iq_DEC output from the driver during the deceleration step.

Furthermore, an average value Iqe_ACC of the current value measured in the driver during the acceleration step may be applied as the acceleration output current value. An average value Iqe_DEC of the current value measured in the driver during the deceleration step may be applied as the deceleration output current value.

In either case, the laundry amount may be calculated only using one factor, that is, the current value. Since the factor of the voltage value may be omitted, the laundry amount calculation may be simplified, and the speed and accuracy of the laundry amount can be improved. Therefore, even when the time duration of the acceleration step is very short or the time duration of the deceleration step is very short, the laundry amount can be accurately detected, and thus the time duration itself required for the laundry amount detection can be further reduced.

When performing the water-trapping balloon detection by the laundry treating apparatus according to the present disclosure, the laundry amount is measured upon decelerating the drum immediately after deceleration thereof. Therefore, the time duration consumed for measuring the laundry amount itself is very short. A further advantage is that the laundry inside the drum 4 cannot move during the time duration. Therefore, since the laundry amount can be detected for a short time duration for which the location of the laundry and the moisture contained in the laundry are substantially constant, the accuracy of the laundry amount calculation can be further increased.

In one example, the calculation equation applied to the laundry amount detection according to the present disclosure uses the difference between the current value at the deceleration step and the current value at the acceleration step. Therefore, since a frictional force of the driver in the acceleration step and a frictional force of the driver in the deceleration step are equal to each other, compensation formulas of the current considering the frictional force cancel each other. Therefore, the laundry amount detection control method by the laundry treating apparatus according to the present disclosure does not need to consider the friction force of the driver 9, so that the process of correcting or tuning the friction force can be omitted. Further, since the laundry amount detection according to the present disclosure does not use a voltage value, a process of compensating for or tuning an error of the voltage value can be omitted. Since the constant velocity process is omitted, the process of compensating for or tuning the laundry movement and the friction of the driver 9 can be omitted. As a result, when using the laundry amount detection control method by the laundry treating apparatus according to the present disclosure, the laundry amount is immediately obtained by applying the current value to the calculation equation. Since there is no procedure to compensate for or tune the laundry amount, the laundry amount can be detected very quickly and accurately.

Therefore, a load on the controller P can be reduced. The present approach may employ the controller P with a relatively simple configuration, or allocate a portion of capacity of the controller P to another tasks.

In one example, the above calculation shows that the acceleration measurement value may further include the speed change amount at the acceleration step, and the deceleration measurement value may further include a speed change amount at the deceleration step.

The speed change amount at the acceleration step and the speed change amount at the deceleration step are only necessary to obtain a difference between an inertia at the acceleration step and an inertia at the deceleration step. Further, a separate voltage value measurement may not be necessary. Furthermore, no compensation or tuning process is required.

In more detail, the above calculation is derived using following equations.

$$\text{(acceleration)}I=\frac{T_e^{Acc}}{D_m^{Acc}-D_m^{Dec}}\ \text{(deceleraion)}I=\frac{T_e^{Dec}}{D_m^{Acc}-D_m^{Dec}}$$

$$\text{where } D_m=\frac{d\omega_m}{dt}=\frac{\Delta\omega_m}{\Delta t}$$

In this connection, the amount of change in the speed is required because the laundry amount is calculated from the difference between the acceleration inertia and deceleration inertia.

Therefore, when the acceleration measurement value and the deceleration measurement value are measured in the same RPM section for the drum, the calculation can be simpler because a range of the speed change is the same between the acceleration measurement and the deceleration measurement. That is, the acceleration step I and the deceleration step II preferably have the same speed RPM section.

Further, the laundry treating apparatus according to the present disclosure may decelerate the driver 9 in a power generation stopping manner by cutting off power at the deceleration step CII. Therefore, an algorithm for controlling the deceleration step CII is omitted. Thus, energy for the deceleration step CII may be saved. Furthermore, the voltage command value may be zero since the power is cut at the deceleration step CII. Therefore, the present approach can detect the laundry amount by calculating only the current while excluding the voltage.

That is, the method for controlling the laundry treating apparatus according to the present disclosure may ignore or not use the voltage command value or the voltage value itself. Since only the current value is used, a calculation formula for laundry amount detection can be provided very simply.

Since the calculation is simplified, the calculation can be quick and accurate, so the laundry amount can be detected accurately.

In one example, unlike the present approach, the acceleration step CI is performed after the deceleration step CII is performed first. In this case, as a sudden current to accelerate the driver 9 flows, a current peak may occur. When the current peak occurs, there is a momentary excessive load on the controller P, such that damage to the circuit equipped with the controller P and the driver 9 may occur. Further, in order to prevent the damage to the controller P and the circuit, an optimal material should be employed or a separate component should be added to improve the durability of the controller P or the circuit. Furthermore, when decelerating and then accelerating the drum, the laundry inside the drum 4 may move, and thus accurate laundry amount may not be measured.

Therefore, in the present approach, to measure the laundry amount, the acceleration step CI is first performed, and, then, the deceleration step CII is performed.

Specifically, the acceleration step CI accelerates the drum to the safety rpm, while the deceleration step CII decelerates the drum at the safety rpm. That is, the acceleration step CI and the deceleration step CII may be continuously performed. This approach does not cause damage to the controller P or the circuit because the deceleration step CII may be carried out either by lowering a current command value at the acceleration step CI applied to the driver 9 or by blocking the voltage applied to the driver 9.

In this connection, the acceleration measurement value and the deceleration measurement value may be measured in a range between the safety rpm and an acceleration rpm lower than the safety rpm. That is, the laundry amount can be detected by measuring the current value in the range including a vertex in the speed graph. This has an advantage of minimizing a situation where an error may occur because the laundry amount is detected by measuring the current value in a continuous situation.

In one example, the acceleration measurement value and the deceleration measurement value may be measured in a range between an acceleration rpm lower than the safety rpm and a detection rpm higher than the acceleration rpm and lower than the safety rpm. In other words, the laundry amount may be detected by measuring the current value in the same speed range but not in the range including the vertex. This has an advantage of improving the accuracy of the laundry amount calculation by measuring the stabilized current value because the speed change is the largest at the vertex.

As a result, the laundry treating apparatus according to the present disclosure sets the laundry state inside the drum to a steady state in the first maintaining step A2, and then accelerates and decelerates momentarily the drum to measure the laundry amount WC. Then, the laundry treating apparatus according to the present disclosure may immediately calculate the moisture ratio and dewatered ratio based on the laundry amount WC. Thus, it is possible to accurately detect the presence or absence of the water-trapping balloon.

Description of the present approach based on the rotational speed of the drum will be made. The first spinning step I maintains the drum's rotational speed at the first speed for the second time duration t2, and then, accelerates the drum rotation speed to a fourth speed faster than the first speed and slower than the second speed and then decelerates the drum to the first speed.

In this connection, the first spinning step accelerates the drum's rotation speed to the fourth speed and then decelerates the drum to the first speed, and then increase the drum's rotation speed to the third speed or stop the drum's rotation.

That is, the controller may be configured to determine whether to accelerate or stop the drum based on the presence or absence of the water-trapping balloon in the process of momentarily accelerating and decelerating the drum.

Figure 8:
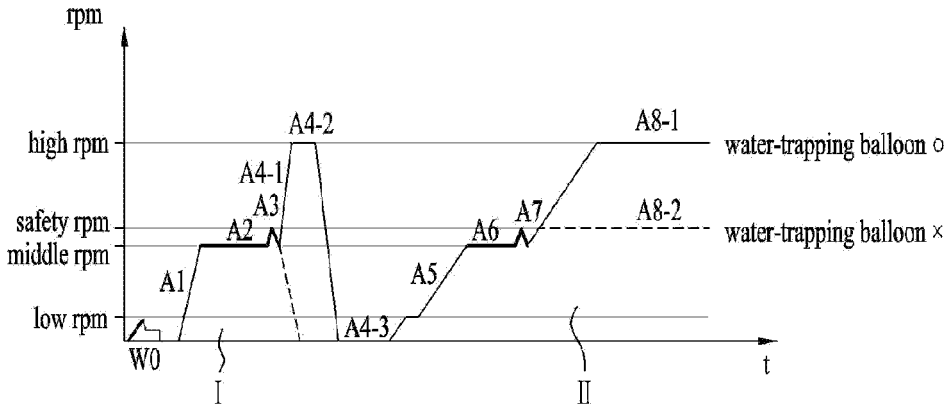
FIG. 8 illustrates a third embodiment of a spinning process in which a water-trapping balloon is detected and removed by a laundry treating apparatus in accordance with the present disclosure.

FIG. 8 shows a last embodiment of a laundry treating apparatus according to the present disclosure.

The embodiment of FIG. 8 is the same as the embodiment of FIG. 6 in term of the process to and including the first spinning step I. The second spinning step II may be different therebetween.

The second spinning step II includes a second rising step A5 for accelerating the drum speed to the first speed and a second maintaining step A6 for maintaining the drum speed at the first speed for a second time duration. The second spinning step II further includes a second water-trapping balloon detection step A7 to detect unbalance of the drum in the second maintaining step A6, or to determine whether the laundry contained in the drum has a water-trapping balloon by measuring the amount of current applied to the driver in the second maintaining step A6.

The second water-trapping balloon detection step A7 may determine that there is present a water-trapping balloon in the laundry when, in the process of the drum rotating at the first speed, the unbalance of the drum continues to increase or exceeds the reference value.

In other words, when a water-trapping balloon is present in the second maintaining step A6, the unbalance will increase over time. Thus, the controller may continuously measure the unbalance value to detect the presence or absence of water-trapping balloons. Further, the second water-trapping balloon detection step A7 detects the laundry amount of the laundry using the accelerating current value and the decelerating current value and then detect whether the laundry includes the water-trapping balloon by calculating at least one of the moisture ratio and the dewatered ratio of the laundry based on the detected laundry amount. That is, when the moisture ratio is above the reference moisture ratio and the dewatered ratio is lower than the reference dewatered ratio, the second water-trapping balloon detection step A7 may determine that the laundry contains the water-trapping balloon.

In other words, the second water-trapping balloon detection step A7 may be the same as the first water-trapping balloon detection step A3. That is, the second water-trapping balloon detection step A7 includes a spinning acceleration step C1 for accelerating the drum from the first speed to a fourth speed faster than the first speed, and a spinning deceleration step CII for decelerating the drum back to first speed, and a spinning calculation step CIII which measures whether the laundry contains the water-trapping balloon by calculating the acceleration current value at the driver in the spinning acceleration step and the deceleration current value at the driver in the spinning deceleration step.

Since the spinning calculation step CIII is the same as the calculation step of the first water-trapping balloon detection step A3, repeated description thereof is omitted.

In one example, if the water-trapping balloon is not detected in the second water-trapping balloon detection step A7, the second spinning step II may perform the high speed step A8-1 to accelerate the drum to the second speed.

In one example, if the water-trapping balloon is detected in the second water-trapping balloon detection step A7, the second spinning step II may perform the speed *?*limiting step A8-2 to prevent the drum from rotating at the RPM beyond the safe speed lower than the second speed. As a result, the situation may be prevented in which the water-trapping balloon bursts during the high speed rotation of the drum, thereby causing the sudden occurrence of eccentricity.

In one example, the second spinning step II may perform the second water-trapping balloon detection step A7 separately from the first water-trapping balloon detection step A3. However, in order to prevent a washing delay and to block excessive load on the controller, the second water-trapping balloon detection step A7 may be omitted if the water-trapping balloons are detected in the first water-trapping balloon detection step A3.

Description of the second spinning step with reference to the speed of the drum may be made as follows.

If the drum's rotation speed in the first spinning step I is increased to the third speed higher than the first speed, the second spinning step II may raise the drum's rotation speed to the second speed. This is because the increase of the drum speed to third speed means no water-trapping balloon.

In one example, when, in the first spinning step, the rotation speed of the drum does not rise to the third speed and the rotation thereof stops, the second spinning step II may prevent the drum from rotating at a speed beyond the safety speed lower than the second speed. This is because when the drum speed does not rise to the third speed, this means that a water-trapping balloon is detected.

In one example, the second spinning step II accelerates the drum's rotational speed to the first speed and then maintains the rotational speed of the drum at the first speed, and then raise the rotation speed of the drum to the first speed or to stop the rotation of the drum.

A reference factor used to increase or stop the drum speed in the second spinning step is as follows.

When the current value applied to or measured in the driver increases during the second time duration t2 when the drum rotates at the first speed, the second spinning step may prevent the rotation of the drum at a speed beyond the safety speed lower than the second speed. This is because the increase means that there is a water-trapping balloon, and thus, it is necessary to prevent the water-trapping balloon from bursting suddenly due to the centrifugal force.

However, when the current value applied or measured to or in the driver is maintained or decreased during the second time duration t2 when the drum rotates at the first speed, the controller may increase the drum's rotational speed to the second speed. This is because the decrease or being maintained means that there is no water-trapping balloon, and thus, thus the spinning effect should be maximized.

This approach may be equally applied to a case when the current value is replaced with a vibration value.

In one example, the second spinning step II accelerates the drum's rotation speed to the fourth speed and then decelerates the drum speed to the first speed, then and then accelerates the drum's rotation speed to the second speed, or rotates the drum at a speed below the safety speed lower than the second speed.

This is intended for performing momentary acceleration and deceleration of the drum, such that the controller will determine whether to or not to increase the rotational speed of the drum to the speed above the safety speed, depending on whether the controller has detected the water-trapping balloon.

Figure 9:
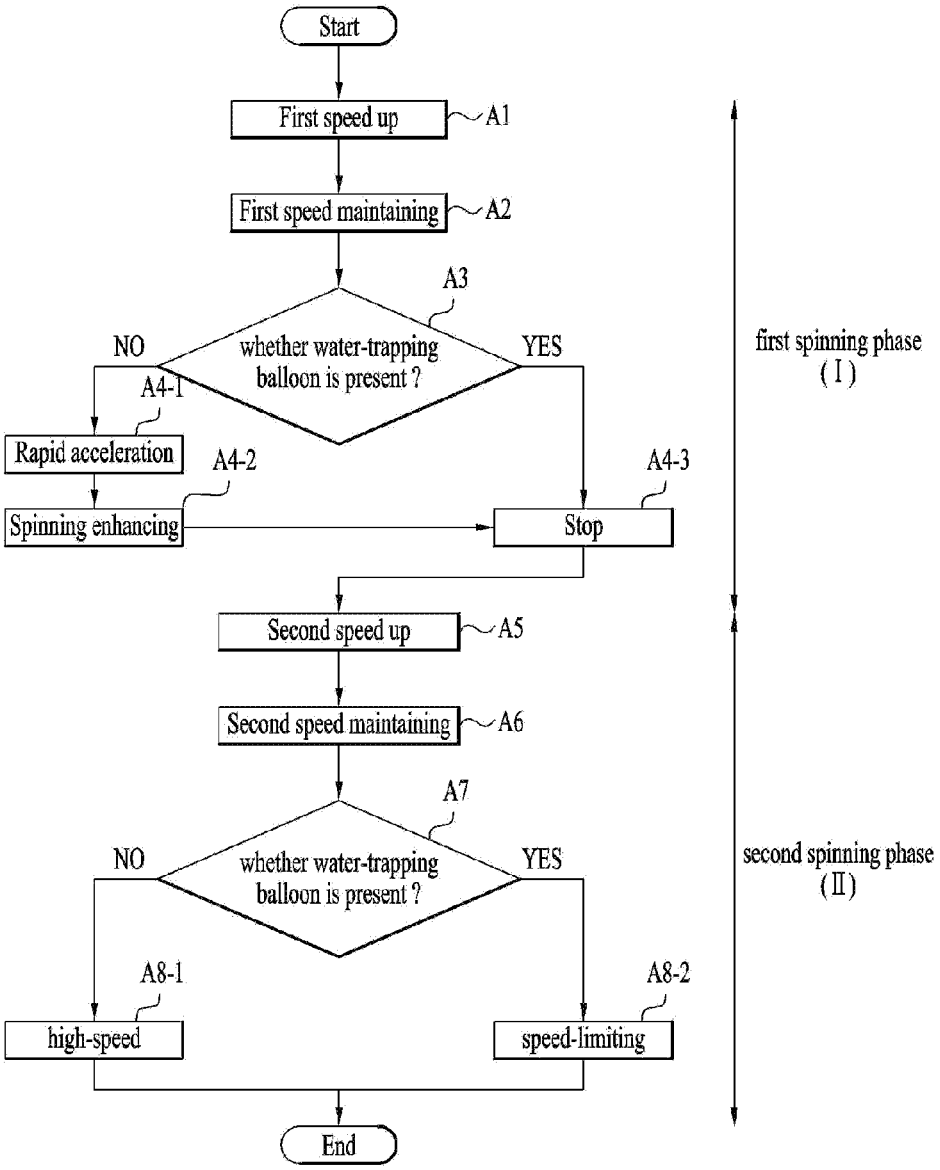
FIG. 9 illustrates an algorithm for a method for controlling a laundry treating apparatus in accordance with the present disclosure, wherein the laundry treating apparatus is capable of implementing all the above-described embodiments.

FIG. 9 is a diagram illustrating an algorithm for controlling a laundry treating apparatus according to the present disclosure as shown in FIGS. 5 to 8.

When the spinning cycle S40 is executed or the spinning is performed in the rinsing cycle S30, the laundry treating apparatus according to the present disclosure detects the wet laundry amount and then performs the first spinning step I. In the first spinning step I, the controller may perform the first speed up step A1 to raise the drum speed to the first speed and the first speed maintaining step A2 to maintain the drum speed.

In this connection, in the process of maintaining the drum speed at the first speed, the first water-trapping balloon detection step A3 is performed to detect the presence or absence of the water-trapping balloon. If there is no water-trapping balloon, the controller may perform the rapid acceleration step A4-1 to accelerate the drum to the third speed and the spinning enhancing step A-2 to maintain the third speed to perform a full spinning at and from the first spinning step I.

However, if it is detected that there is a water-trapping balloon, the controller may perform the stop step A4-3 to stops the drum rotation. Then, the process may remove the water-trapping balloon or control the drum rotation of the second spinning step II so that excessive eccentricity does not occur even when the water-trapping balloon is created.

When the second spinning step II is performed, the controller may execute the second speed up step A5 to raise the drum speed to first speed and the second speed maintaining step A6 to maintain the drum speed at the first speed. That is, in the second spinning step, the drum rotation is not immediately increased to the second speed, but the first speed is maintained to perform a final check of whether the water-trapping balloon is present.

In the maintaining step A6, the second water-trapping balloon detection step A7 for detecting the presence or absence of the water-trapping balloon in the laundry is performed. If no water-trapping balloon is detected, the controller may perform the high speed step A8-1 to raise the drum speed to the second speed. To the contrary, if a water-trapping balloon is detected, the controller may perform the speed limiting step A8-2 to rotate the drum at a constant speed only at a speed below the safe speed.

The present disclosure may be embodied in various forms and the scope of the present disclosure is not limited to the above embodiments. Therefore, when modified embodiments include components recited in the present claims, the modified embodiments should be regarded as falling within the scope of the present disclosure.

The invention claimed is:

1. A method for controlling a laundry treating apparatus that includes a tub, a drum to accommodate laundry, a driver to rotate the drum at a first speed, a second speed or a third speed faster than the first speed, and a controller, wherein the method comprises:

performing a first spinning operation by rotating the drum at the first speed to remove moisture from the laundry; and performing a second spinning operation by rotating the drum at speed, which is greater than the first speed, to remove moisture from the laundry, wherein performing the first spinning operation includes: during a first time duration, accelerating a rotational speed of the drum until reaching the first speed;

during a second time duration after the first time duration, maintaining the rotational speed of the drum at the first speed, wherein the second time duration is longer than the first time duration; and in response to an end of the second time duration, increasing the rotational speed of the drum from the first speed to the third speed, or stopping rotation of the drum, wherein the second speed is a maximum speed of the second spinning operation, and wherein the third speed is equal to the second speed, wherein performing the second spinning operation includes:

when the rotation of the drum is stopped during the first spinning operation, the drum rotates, during the second spinning operation, at a prescribed speed lower than the third speed, when the rotation speed of the drum increases to the third speed during the first spinning operation, the drum rotates, during the second spinning operation, at the second speed higher than the prescribed speed.

2. The method of claim 1, wherein the performing of the first spinning operation includes:

in response to an increase in a current value associated with the driver during the second time duration while the drum rotates at the first speed, stopping rotation of the drum; or in response to decreasing or maintaining a current value associated with the driver during the second time duration while the drum rotates at the first speed, increasing the rotational speed of the drum to the third speed.

3. The method of claim 1, wherein the performing of the first spinning operation includes:

in response to increasing a vibration level detected in the drum during the second time duration while the drum rotates at the first speed, stopping rotation of the drum; or in response to decreasing or maintaining a vibration level detected in the drum during the second time duration while the drum rotates at the first speed, increasing the rotational speed of the drum to the third speed.

4. The method of claim 1, wherein the performing of the first spinning operation includes:

after maintaining the rotational speed of the drum at the first speed during the second time duration, accelerating the rotational speed of the drum to a fourth speed, which is faster than the first speed and slower than the second speed, and then decelerating the rotational speed of the drum to the first speed.

5. The method of claim 4, wherein after the accelerating of the rotational speed of the drum to the fourth speed and then the decelerating of the rotational speed of the drum to the first speed, the performing of the first spinning operation includes:

increasing the rotational speed of the drum to the third speed, or stopping rotation of the drum.

6. The method of claim 1, wherein when the performing of the first spinning operation includes increasing the rotational speed of the drum to the third speed, the performing of the first spinning operation further includes:

during a third time duration after the second time duration, maintaining the rotational speed of the drum at the third speed and then stopping rotation of the drum.

7. The method of claim 2, wherein the performing of the second spinning operation includes:

increasing the rotational speed of the drum to the second speed when the rotational speed of the drum is increased to the third speed during the performing of the first spinning operation.

8. The method of claim 1, wherein the performing of the second spinning operation includes:

accelerating the rotational speed of the drum to the first speed;

maintaining the rotational speed of the drum at the first speed; and increasing the rotational speed of the drum from the first speed to the second speed or stopping rotation of the drum.

9. The method of claim 8, wherein in response to an increase in a current value associated with the driver while maintaining the rotational speed of the drum at the first speed, the method comprises controlling the drum from rotating at a speed which is greater than the prescribed speed lower than the second speed; or in response to decreasing or maintaining a current value associated with the driver while maintaining the rotational speed of the drum at the first speed, the method comprises increasing the rotational speed of the drum to the second speed.

10. The method of claim 8, wherein in response to increasing a vibration level detected in the drum when the rotational speed of the drum increases from the first speed, the method comprises controlling the drum from rotating at a speed which is greater than the prescribed speed lower than the second speed; or in response to decreasing or maintaining a vibration level detected in the drum when the rotational speed of the drum increases from the first speed, the method comprises increasing the rotational speed of the drum to the second speed.

11. The method of claim 8, wherein the performing of the first spinning operation includes:

accelerating the rotational speed of the drum to a fourth speed which is faster than the first speed, and then decelerating the rotational speed of the drum to the first speed; and accelerating the rotational speed of the drum from the first speed to the second speed, or rotating the drum at a speed below the prescribed speed lower than the second speed.

12. A laundry treating apparatus comprising:

a tub for storing water therein;

a drum received in the tub to accommodate laundry therein;

a driver coupled to the tub to rotate the drum at a first speed, a second speed or a third speed faster than the first speed; and a controller configured to detect a current associated with the driver, wherein the controller is configured to:

perform a first spinning operation by rotating the drum at the first speed to remove moisture from the laundry; and perform a second spinning operation by rotating the drum at the second-a speed, which is greater than the first speed, to remove moisture from the laundry, wherein to perform the first spinning operation includes:

during a first time duration, accelerate a rotational speed of the drum until reaching the first speed;

during a second time duration after the first time duration, maintain the rotational speed of the drum at the first speed, wherein the second time duration is longer than the first time duration; and in response to an end of the second time duration, increase the rotational speed of the drum from the first speed to the third speed, or stopping rotation of the drum, wherein the second speed is a maximum speed of the second spinning operation, and wherein the third speed is equal to the second speed, wherein performing the second spinning operation includes:

when the rotation of the drum is stopped during the first spinning operation, the drum rotates, during the second spinning operation, at a prescribed speed lower than the third speed, when the rotation speed of the drum increases to the third speed during the first spinning operation, the drum rotates, during the second spinning operation, at the second speed higher than the prescribed speed.

13. The apparatus of claim 12, wherein the performing of the first spinning operation includes:

in response to an increase in a current value associated with the driver during the second time duration while the drum rotates at the first speed, stopping rotation of the drum; or in response to decreasing or maintaining a current value associated with the driver during the second time duration while the drum rotates at the first speed, increasing the rotational speed of the drum to the third speed.

14. The apparatus of claim 12, wherein the performing of the first spinning operation includes:

in response to increasing a vibration level detected in the drum during the second time duration while the drum rotates at the first speed, stopping rotation of the drum; or in response to decreasing or maintaining a vibration level detected in the drum during the second time duration while the drum rotates at the first speed, increasing the rotational speed of the drum to the third speed.

15. The apparatus of claim 12, wherein the performing of the first spinning operation includes:

after maintaining the rotational speed of the drum at the first speed during the second time duration, accelerating the rotational speed of the drum to a fourth speed, which is faster than the first speed and slower than the second speed, and then decelerating the rotational speed of the drum to the first speed.

16. The apparatus of claim 15, wherein after the accelerating of the rotational speed of the drum to the fourth speed and then the decelerating of the rotational speed of the drum to the first speed, the performing of the first spinning operation includes:

increasing the rotational speed of the drum to the third speed, or stopping rotation of the drum.

17. The apparatus of claim 12, wherein when the performing of the first spinning operation includes increasing the rotational speed of the drum to the third speed, the performing of the first spinning operation further includes:

during a third time duration after the second time duration, maintaining the rotational speed of the drum at the third speed and then stopping rotation of the drum.

* * * * *